US010948839B2

(12) United States Patent
Tsubaki et al.

(10) Patent No.: US 10,948,839 B2
(45) Date of Patent: Mar. 16, 2021

(54) TONER HAVING A TONER PARTICLE WITH A BINDER RESIN CONTAINING A COPOLYMER OF A STYRENIC POLYMERIZABLE MONOMER, AND AT LEAST ONE OF AN ACRYLIC OR METHACRYLIC POLYMERIZABLE MONOMER

(71) Applicant: CANON KABUSHIKI KAISHA, Tokyo (JP)

(72) Inventors: Keiichiro Tsubaki, Numazu (JP); Naoya Isono, Suntou-gun (JP); Yasuaki Murai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/662,123

(22) Filed: Oct. 24, 2019

(65) Prior Publication Data

US 2020/0133152 A1 Apr. 30, 2020

(30) Foreign Application Priority Data

Oct. 30, 2018 (JP) ..... JP2018-204456
Mar. 27, 2019 (JP) ..... JP2019-060041

(51) Int. Cl.
*G03G 9/087* (2006.01)

(52) U.S. Cl.
CPC ..... *G03G 9/08793* (2013.01); *G03G 9/08711* (2013.01)

(58) Field of Classification Search
CPC ..... G03G 9/0825; G03G 9/0821; G03G 9/08711; G03G 9/0806
See application file for complete search history.

(56) References Cited

U.S. PATENT DOCUMENTS 5,256,516 A * 10/1993 Winnik ..... G03G 9/08791 424/DIG. 16
5,395,723 A 3/1995 Mahabadi et al.
7,141,342 B2 11/2006 Toyoda et al.
7,288,357 B2 10/2007 Toyoda et al.
7,833,685 B2 11/2010 Tanaka et al.
8,211,606 B2 7/2012 Murai et al.
8,367,289 B2 2/2013 Isono et al.
8,377,616 B2 2/2013 Tani et al.
8,440,382 B2 5/2013 Isono et al.
8,497,054 B2 7/2013 Sugiyama et al.
8,628,899 B2 1/2014 Kawamura et al.
8,652,737 B2 2/2014 Handa et al.
8,778,581 B2 7/2014 Nonaka et al.
8,815,484 B2 8/2014 Tanaka et al.
9,158,216 B2 10/2015 Shimano et al.
9,377,705 B2 6/2016 Shimano et al.
9,383,668 B2 7/2016 Noji et al.
9,500,972 B2 11/2016 Tanaka et al.
9,556,290 B2 1/2017 Nishiura et al.
9,575,424 B2 2/2017 Nakagawa et al.
9,599,919 B2 3/2017 Isono et al.
9,658,549 B2 5/2017 Tanaka et al.
9,715,187 B2 7/2017 Mukumoto et al.
9,785,071 B2 10/2017 Shimano et al.
9,829,814 B2 11/2017 Yoshida et al.
9,829,816 B2 11/2017 Tanaka et al.
9,835,964 B2 12/2017 Yoshida et al.
9,904,193 B2 2/2018 Nakagawa et al.
9,958,801 B2 5/2018 Tanaka et al.
10,078,279 B2 9/2018 Nakagawa et al.
10,101,681 B2 10/2018 Tagawa et al.
10,216,107 B2 2/2019 Tsubaki et al.
2005/0069799 A1* 3/2005 Toman ..... G03G 9/08795 430/108.4
2005/0209364 A1 9/2005 Yamagishi et al.
2007/0254231 A1* 11/2007 Sakamoto ..... G03G 9/08708 430/109.3
2010/0297547 A1* 11/2010 Hirota ..... C08L 67/00 430/109.4
2011/0136053 A1* 6/2011 Akers, Jr. ..... C08G 83/005 430/108.4
2014/0356779 A1 12/2014 Hasegawa et al.
(Continued)

FOREIGN PATENT DOCUMENTS

JP H06-130722 5/1994
JP H07-219272 8/1995
JP 2009249561 A * 10/2009
(Continued)

OTHER PUBLICATIONS

English language machine translation of JP 2009-249561, (Year: 2009).*
Ishizu, et. al., "Synthesis of hyperbranched polymers by self-addition free radical vinyl polymerization of photo functional styrene", Macromol. Rapid Commun., vol. 21 (2000) 665-68.
Suzuki, et. al., "Multibranching Polymerization: Palladium-Catalyzed Ring-Opening Polymerization of Cyclic Carbamate to Produce Hyperbranched Dentritic Polyamine", Macromolecules, vol. 25 (1992) 7071-72.
(Continued)

*Primary Examiner* — Christopher D Rodee
(74) *Attorney, Agent, or Firm* — Venable LLP

(57) ABSTRACT

The toner contains a toner particle that has a binder resin, wherein an amount of a tetrahydrofuran THF-insoluble matter A collected when a THF dispersion of the binder resin is passed through a first filter having an average pore diameter of 8 μm, is not more than 10 mass % of the binder resin, and an amount of a THF-insoluble matter B collected when the THF dispersion that has been passed through the first filter is passed through a second filter having an average pore diameter of 0.8 μm, is from 5 mass % to 50 mass % of the binder resin.

2 Claims, No Drawings

(56) References Cited

U.S. PATENT DOCUMENTS

2014/0377697 A1 12/2014 Nishiura et al.

FOREIGN PATENT DOCUMENTS

| | | |
|---|---|---|
| JP | 2011-501231 | 1/2011 |
| WO | 2009/054676 | 4/2009 |

OTHER PUBLICATIONS

Suzuki, et. al., "New Ring-Opening Polymerization via a Π-Allylpalladium Complex. 5. Multibranching Polymerization of Cyclic Carbamate to Produce Hyperbranched Dendritic Polyamine", Macromolecules, vol. 31 (1998) 1716-19.
U.S. Appl. No. 16/662,130, Naoya Isono, filed Oct. 24, 2019.

* cited by examiner

TONER HAVING A TONER PARTICLE WITH A BINDER RESIN CONTAINING A COPOLYMER OF A STYRENIC POLYMERIZABLE MONOMER, AND AT LEAST ONE OF AN ACRYLIC OR METHACRYLIC POLYMERIZABLE MONOMER

BACKGROUND OF THE INVENTION

Field of the Invention

The present invention relates to a toner used to form a toner image by the development of the electrostatic latent image formed by a method such as an electrophotographic method, electrostatic recording method, or toner jet system recording method.

Description of the Related Art

An image-forming method that proceeds via the development of an electrostatic latent image is used in copiers, multifunction machines, and printers. Generally in this image-forming method, an electrostatic latent image is formed on a photosensitive member, a toner image is then formed by the development of this electrostatic latent image using toner, this toner image is transferred to a transfer material, e.g., paper, and a fixed image is subsequently obtained by fixing the toner image to the transfer material by a fixing method that employs the application of heat and pressure.

Various methods have been developed for the process of fixing the toner image to the transfer material. Examples here are the heated roller fixing method, in which the toner image is fixed to the transfer material using a heated roller and a pressure roller, and the film fixing method, in which the toner image is fixed to the transfer material by close contact between a pressure member and a heater with a film interposed therebetween.

Because the toner image on the transfer material is in contact with the surface of the film or heated roller in these fixing methods, they exhibit an excellent thermal efficiency during melt adhesion of the toner image onto the transfer material and thus can carry out fixing very rapidly. These fixing methods are widely deployed in multifunction machines and printers as a consequence.

However, in these fixing methods, because contact is effected in the molten state between the toner and the surface of the fixing member, e.g., the film or heated roller, an offset phenomenon can be produced in which some of the toner ends up sticking to the surface of the fixing member and the toner attached to the film or heated roller is then ultimately retransferred to the fixing material. To respond to this problem, offset is generally suppressed by controlling the viscoelasticity of the toner through the formation of a high-molecular-weight component (also referred to as a gel) achieved by the crosslinking of all or a portion of the binder resin in the toner. This method results in a substantial improvement in the offset property of the toner.

However, high-gloss images have come to be required at the present time due to the advance of full color capabilities in copiers and printers, and, since the high-molecular-weight component (gel) formed by crosslinking does influence the gloss in the methods referenced above, it has been a problem to satisfy both the offset property and a high gloss appearance at the same time.

To respond to this problem, for example, the use of a microgel in the toner is proposed in Japanese Patent Application Laid-open No. H07-219272.

A method that uses a high crosslink density microgel in the toner is proposed in Japanese Patent Application Laid-open No. H06-130722.

Japanese Translation of PCT Application No. 2011-501231, on the other hand, proposes a method in which a crosslinked resin is arranged in a plurality of island forms in the toner particle.

SUMMARY OF THE INVENTION

As noted above, accompanying the higher speeds in multifunction machines and printers in recent years, there has been demand for additional improvements in the offset property and gloss, but it has been found that the method in Japanese Patent Application Laid-open No. H07-219272 is inadequate for bringing about coexistence between the offset property and high gloss. It has also been found that the methods in Japanese Patent Application Laid-open No. H06-130722 and Japanese Translation of PCT Application No. 2011-501231 do not adequately achieve a high gloss.

The present invention provides a toner that maintains a high gloss while also exhibiting an excellent offset property.

The toner contains a toner particle that has a binder resin, wherein an amount of a tetrahydrofuran THF-insoluble matter A that can be collected when a THF dispersion of the binder resin is passed through a first filter having an average pore diameter of 8 μm, is not more than 10 mass % of the binder resin, and an amount of a THF-insoluble matter B that can be collected when the THF dispersion that has been passed through the first filter is passed through a second filter having an average pore diameter of 0.8 μm, is from 5 mass % to 50 mass % of the binder resin.

The present invention thus provides a toner that maintains a high gloss while also exhibiting an excellent offset property.

Further features of the present invention will become apparent from the following description of exemplary embodiments.

DESCRIPTION OF THE EMBODIMENTS

Unless specifically indicated otherwise, expressions such as "from XX to YY" and "XX to YY" that show numerical value ranges refer in the present invention to numerical value ranges that include the lower limit and upper limit that are the end points.

The toner according to the present invention is a toner that contains a toner particle that has a binder resin, wherein an amount of a tetrahydrofuran THF-insoluble matter A that can be collected when a THF dispersion of the binder resin is passed through a first filter having an average pore diameter of 8 μm, is not more than 10 mass % of the binder resin, and an amount of a THF-insoluble matter B that can be collected when the THF dispersion that has been passed through the first filter is passed through a second filter having an average pore diameter of 0.8 μm, is from 5 mass % to 50 mass % of the binder resin.

The present inventors discovered that a toner that maintains a high gloss while also exhibiting an excellent offset property is obtained when, for the binder resin present in the toner, the amount of the THF-insoluble matter A is not more than 10 mass % of the binder resin and the amount of the THF-insoluble matter B is from 5 mass % to 50 mass % of the binder resin.

The detailed mechanisms pertaining to these characteristics are thought to be as follows.

A binder resin having a molecular structure that is highly compatible with THF such that the stipulations given above are satisfied is uniformly dispersible in THF and contains THF-soluble matter that can pass through a second filter having an average pore diameter of 0.8 μm and THF-insoluble matter (gel) that is retained by the second filter having an average pore diameter of 0.8 μm.

Increasing the viscoelasticity of a toner is generally preferred for bringing about an improved hot offset property for the toner. A method frequently used in order to increase the viscoelasticity is to disperse a gel, such as that described in the patent literature given above, in the binder resin.

An indicator of the ease of dispersion of a gel in the binder resin is the entanglement of the polymer chains in the gel, i.e., the extent of the gel.

Accordingly, the present inventors believe that a trend of improvement in the post-fixing hot offset property occurs when the THF-insoluble matter (gel) has a large size.

The gloss of the fixed toner image, on the other hand, is thought to be influenced by the surface roughness (unevenness of the surface) of the toner layer at the time of fixing. When a state of high compatibility exists between the THF-soluble matter and the THF-insoluble matter (gel), the THF-insoluble matter (gel) is then also uniformly dispersed in the toner layer after fixing, and in this case a larger size for the THF-insoluble matter (gel) provides a rougher surface roughness for the toner layer and the gloss then declines.

Due to the use in the prior art of, for example, a crosslinking agent, to obtain the gel, a gel with a large size as noted above has been obtained.

The presence of a large-size gel results in an increase in the viscoelasticity of the toner and provides an excellent offset property, but does have an effect on the surface roughness of the toner layer post-fixing with the gloss being reduced.

Investigations by the present inventors have shown that this large-size gel is the THF-insoluble matter A that can be collected during passage through a first filter having an average pore diameter of 8 μm.

As a consequence, the amount of the THF-insoluble matter A must be not more than 10 mass % of the binder resin.

On the other hand, the THF-insoluble matter B, which can pass through a first filter having an average pore diameter of 8 μm and can be collected by a second filter having an average pore diameter of 0.8 has a small gel size and thus can be regarded as a microgel. When this microgel is present in the toner in the prescribed amount as given above, the viscoelasticity of the toner is increased just as for the THF-insoluble matter A and an excellent offset property is provided. Moreover, because the THF-insoluble matter B is different from the THF-insoluble matter A in having a small gel size, it exercises little effect on the surface roughness of the toner layer post-fixing and a high-gloss image is obtained.

The amount of the THF-insoluble matter A is preferably not more than 5 mass % of the binder resin. Less THF-insoluble matter A is better in terms of obtaining an excellent gloss. As a consequence, the lower limit is preferably equal to or greater than 0 mass %.

The THF-insoluble matter A may be brought to not more than 10 mass % of the binder resin by, for example, a method such as reducing the amount of crosslinking agent addition to keep down the amount of gel production.

The amount of THF-insoluble matter B is from 5 mass % to 50 mass % of the binder resin and is preferably from 10 mass % to 45 mass %. The offset property is excellent at 5 mass % at above, while a high-gloss image is obtained at 50 mass % and below. As a consequence, by satisfying the indicated range, a toner is obtained that exhibits an excellent offset property while also maintaining a high gloss. The THF-insoluble matter B can be controlled by the method described below.

The degree of THF swelling of the THF-insoluble matter B is preferably from 2.0 to 20.0.

The degree of THF swelling can be measured as follows. First, a prescribed amount of the dried THF-insoluble matter B, obtained by the procedure described below under <Measurement of the Amount of THF-Insoluble Matter>, is exactly weighed out and this is designated as the pre-swelling mass. The THF-insoluble matter B is then swelled for 24 hours with THF at 20° C., after which the excess THF is removed by decantation. The mass of the THF-insoluble matter B is then exactly weighed, and this is designated as the post-swelling mass. Their ratio (post-swelling mass/pre-swelling mass) is taken to be the degree of THF swelling.

Thus, when the degree of THF swelling is large, this indicates a low crosslink density because the network structure of the gel fraction, absorbing solvent to the corresponding extent, can swell (increase in volume). On the other hand, a low degree of THF swelling is an indicator that shows a high crosslink density because the network structure of the gel fraction, absorbing solvent to the corresponding extent, is unable to swell.

The present inventors believe that this crosslink density of the gel correlates with the viscoelastic characteristics of the toner in the same manner as the gel size as described above. When the crosslink density is low, the action is the same as for the THF-soluble matter contained in the binder resin. Due to this, by having the degree of THF swelling be at least the aforementioned lower limit, the crosslink density is increased to some degree and as a result the mechanical strength of the gel is increased and an increase in the viscoelasticity of the toner is facilitated.

When, on the other hand, the degree of THF swelling is made equal to or less than the upper limit indicated above, the gel has a high mechanical strength. Moreover, the gel is readily expanded to a certain degree and the occurrence of gel-to-gel interaction or its interaction with the THF-soluble matter in the binder resin is facilitated, and as a consequence an increase in the viscoelasticity of the toner is facilitated.

The degree of THF swelling can be controlled, for example, through the amount of crosslinking agent addition.

THF-insoluble matter B in the mass proportion prescribed above can be obtained, for example, by kneading and applying shear to the THF-insoluble matter A at a suitable intensity to cleave the polymer chains in the gel and produce a smaller-size gel, or by forming a gel using a crosslinking agent that has a dendritic structure.

The THF-insoluble matter B is preferably formed using a polymeric crosslinking agent having a dendritic structure. That is, the THF-insoluble matter B preferably has a structure that has been crosslinked using a crosslinking agent having a dendritic structure. A dendritic structure is a type of multibranched polymer structure that has a branched structure that extends from a center radially outward while branching dendritically, such as a dendrimer, hyperbranched polymer, or starburst polymer.

Because dendrimers are synthesized in stages in each generation from a small molecule (in the case of a dendrimer, the generation refers to the number of repetitions of the branching obtained depending on the stage of synthesis), dendrimers are characterized by an almost complete absence of branching defects and also by a molecular weight distribution that is monodisperse at 1. Hyperbranched polymers and the like have numerous branching defects and their branched structures lack the regularity of dendrimers; however, they offer an industrial advantage in that they can be produced by a single stage or two stage reaction from a compound typically of the type ABx.

A polymer having a dendritic structure has a higher functional group density per molecular unit of the surface layer zone than does a linear or branched polymer, and when several generations are elaborated the density of the surface layer zone increases and a structure resembling a sphere is assumed due to steric hindrance among the branched polymers in the tree. Due to this, there is little molecular chain entanglement at the surface layer zone and polymers having a dendritic structure are known to exhibit a distinctive behavior with regard to, for example, the melt characteristics and the molecular weight dependence of the viscosity.

The THF-insoluble matter B preferably has a structure crosslinked by a crosslinking agent that has at least 10 crosslinking functional groups in the molecule. More preferably, THF-insoluble matter B is a branched polymer having a dendritic structure and, for example, has a structure crosslinked by a crosslinking agent having at least 10 crosslinking functional groups in a dendritic polymer molecule.

The crosslinking functional group is preferably a polymerizable functional group, for example, a polymerizable unsaturated group such as the vinyl group (including the acryloyl group and methacryloyl group), or a condensation polymerizable group such as an alcohol, carboxylic acid, or amine. The crosslinking functional group is preferably a vinyl group and is more preferably an acryloyl group or methacryloyl group.

The number of crosslinking functional groups per one molecule (preferably the sum of the number of vinyl groups including the acryloyl group and methacryloyl group) is preferably 10 to 200 and is more preferably 10 to 150.

Thus, the crosslinking agent is preferably a dendritic acrylate or a dendritic methacrylate.

Because this crosslinking agent has the crosslinking functional groups in a high density state in the molecule, a microgel is formed due to the crosslinking reaction between the polymerizable monomer and crosslinking agent that proceeds locally at the periphery where the crosslinking agent is present in the system. This microgel has less ability than a conventional gel to influence the mirror surface of the image at the time of fixing and a high gloss image is obtained as a result.

The offset property is also excellent due to the ability to also satisfactorily introduce the gel component required to control the viscoelasticity of the toner. By having this crosslinking agent have a dendritic structure, microgel production is facilitated because intramolecular crosslinking precedes intermolecular crosslinking. As a consequence, there is no loss in the dispersibility of the colorant and a high tinting strength is exhibited.

The weight-average molecular weight (Mw) of the crosslinking agent having a dendritic structure is preferably from 4,000 to 50,000. When this range is satisfied, the dispersibility in the polymerizable monomer and binder resin is excellent and because of this the microgel that forms is well dispersed and excellent toner properties can be expressed.

Specific examples when the dendritic structure is a dendrimer are structures in which the branched framework structure is, for example, a multibranched polyurea, multibranched polyamide, multibranched polyurethane, multibranched polyester, multibranched polyamideamine, multibranched polycarbonate, multibranched polyether, multibranched poly(etherketone), multibranched poly(propyleneimine), or multibranched polyalkylamine.

In addition, when a defect in the branching structure is produced at a stage in the synthesis of the dendritic structure, a tendency is seen whereby the molecular weight distribution becomes polydisperse; however, the dendritic structure may be polydisperse.

Specific examples of hyperbranched polymers in which the dendritic structure is formed by a compound typically of the ABx type are, as for the dendrimers given above, structures in which the branched framework structure is, for example, a multibranched polyurea, multibranched polyamide, multibranched polyurethane, multibranched polyester, multibranched polyamideamine, multibranched polycarbonate, multibranched polyether, multibranched poly (etherketone), multibranched poly(propyleneimine), or multibranched polyalkylamine.

Preferred is a hyperbranched polymer obtained by a synthesis method, for example, as reported in the following literature: an amine-type multibranched polymer given by a ring-opening polymerization reaction using an amine as nucleophilic component and using a palladium catalyst (M. Suzuki et al., Macromolecules, Volume 25, page 7071 (1992); ibid., Volume 31, page 1716 (1998)), and a multibranched polymer obtained by the living radical polymerization of a monomer having a photoinducible diethyldithiocarbamate group (K. Ishizu et al., Macromol. Rapid Commun., Volume 21, page 665 (2000)).

The crosslinking agent having a dendritic structure is more preferably a crosslinking agent provided by the Michael addition reaction of a polyvalent mercapto compound represented by the following formula (2) to a multifunctional (meth)acrylate compound represented by the following formula (1).

(1)

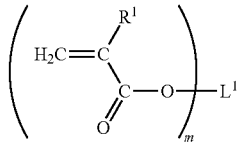

(2)

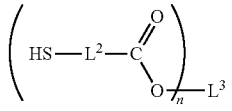

In formula (1), $R^1$ represents a hydrogen atom or an alkyl group having 1 to 4 carbon atoms; $L^1$ represents an m-valent linear or branched aliphatic hydrocarbon group optionally having a hydroxy group, or an ether bond-containing m-valent linear or branched aliphatic hydrocarbon group optionally having a hydroxy group; and m is an integer from 3 to 6.

The ether bond-containing aliphatic hydrocarbon group refers to a configuration in which an ether bond —O— is present in the chain of the aliphatic hydrocarbon group, and the number of ether bonds is preferably 1.

In formula (2), $L^2$ represents an alkylene group; $L^3$ represents an n-valent linear or branched aliphatic hydrocarbon group optionally having a hydroxy group, or an ether bond-containing n-valent linear or branched aliphatic hydrocarbon group optionally having a hydroxy group; and n is an integer from 3 to 6.

$R^1$ in formula (1) preferably is a hydrogen atom or methyl group. $L^1$ preferably represents an m-valent linear or branched aliphatic hydrocarbon group having 5 to 10 carbon atoms and possibly having a hydroxy group, or represents an ether bond-containing m-valent linear or branched aliphatic hydrocarbon group having 5 to 10 carbon atoms and possibly having a hydroxy group. m is an integer from 3 to 6 (preferably 4 to 6).

$L^1$ is more preferably a pentaerythritol structure in which m is 3 or 4, that is, a group obtained by the elimination of 3 or 4 of the hydroxy groups from pentaerythritol, or a dipentaerythritol structure in which m is 5 or 6, that is, a group obtained by the elimination of 5 or 6 hydroxy groups from dipentaerythritol.

The multifunctional (meth)acrylate compound with formula (1) can be specifically exemplified by trimethylolpropane tri(meth)acrylate, ethylene oxide-modified trimethylolpropane tri(meth)acrylate, propylene oxide-modified trimethylolpropane tri(meth)acrylate, trimethylolethane tri(meth)acrylate, pentaerythritol tri(meth)acrylate, pentaerythritol tetra(meth)acrylate, dipentaerythritol penta(meth)acrylate, dipentaerythritol hexa(meth)acrylate, caprolactone-modified pentaerythritol tri(meth)acrylate, caprolactone-modified pentaerythritol tetra(meth)acrylate, and caprolactone-modified dipentaerythritol hexa(meth)acrylate. These compounds may be used alone or in combination of two or more.

At least one selected from the group consisting of pentaerythritol tri(meth)acrylate, pentaerythritol tetra(meth)acrylate, dipentaerythritol penta(meth)acrylate, and dipentaerythritol hexa(meth)acrylate is preferred.

In formula (2), $L^2$ preferably represents an alkylene group having 1 to 3 carbon atoms (more preferably methylene); $L^3$ represents an n-valent linear or branched aliphatic hydrocarbon group having 5 to 10 carbon atoms and possibly having a hydroxy group, or an ether bond-containing n-valent linear or branched aliphatic hydrocarbon group having 5 to 10 carbon atoms and possibly having a hydroxy group; and n is an integer from 3 to 6 (preferably 4 to 6).

$L^3$ is more preferably a pentaerythritol structure in which m is 4, that is, a group obtained by the elimination of the 4 hydroxy groups from pentaerythritol; or a dipentaerythritol structure in which m is 6, that is, a group obtained by the elimination of the 6 hydroxy groups from dipentaerythritol; or a trimethylolpropane structure in which m is 3, that is, a group obtained by the elimination of the 3 hydroxy groups from trimethylolpropane.

The polyvalent mercapto compound with formula (2) can be exemplified by trimethylolpropane tri(mercaptoacetate), trimethylolpropane tri(mercaptopropionate), pentaerythritol tetra(mercaptoacetate), pentaerythritol tri(mercaptoacetate), pentaerythritol tetra(mercaptopropionate), dipentaerythritol hexa(mercaptoacetate), and dipentaerythritol hexa(mercaptopropionate).

At least one selected from the group consisting of trimethylolpropane tri(mercaptoacetate), pentaerythritol tetra(mercaptoacetate), and dipentaerythritol hexa(mercaptoacetate) is preferred.

The amounts of use in the crosslinking agent of the compounds with formulas (1) and (2) should be selected as appropriate in conformity to the number of functional groups in each and is not particularly limited.

For example, the content in the crosslinking agent of the structure originating with the compound with formula (1) is preferably from 50 mass % to 95 mass %. The content in the crosslinking agent of the structure originating with the compound with formula (2) is preferably from 5 mass % to 50 mass %. The structure originating with the compound with formula (1) and the structure originating with the compound with formula (2) also includes, in addition to the structure provided by the addition reaction of the particular compound, the unreacted compound.

A single crosslinking agent having a dendritic structure may be incorporated or a plurality of species thereof may be incorporated.

With regard to the THF-insoluble matter (gel) formed by the crosslinking agent having a dendritic structure, it is thought that, due to the dendritic structure of the crosslinking agent, intramolecular crosslinking precedes intermolecular crosslinking and the production of the THF-insoluble matter B, which is a microgel, is facilitated. It is hypothesized that the crosslinking agent having a dendritic structure obtained by the addition reaction between the compound with formula (1) and the compound with formula (2), because it has a suitable degree of crosslinking and size of the crosslinking agent molecule and distribution thereof, forms a more nonuniform microgel. It is thought that as a result an improved toner durability is obtained along with a high-gloss image.

To the extent that the effects of the present invention are not impaired, another compound may be reacted in the addition reaction between the compound with formula (1) and the compound with formula (2). For example, a mercapto compound represented by the following formula (A) can be used with the goal of controlling the number of (meth)acryloyl groups. Thus, the polymeric compound provided by the addition reaction between at least the compound with formula (1) and the compound with formula (2) may be a polymeric compound provided by the addition reaction of a compound with formula (2) and a compound with formula (A) to a compound with formula (1).

$$HS—R^3 \quad (A)$$

(In the formula, $R^3$ is an alkyl group having 1 to 6 (preferably 1 to 4) carbon atoms.)

In addition, the crosslinking agent having a dendritic structure preferably contains a compound represented by formula (3). The occurrence of intermolecular crosslinking in the microgel formation process is also facilitated by this compound with the durability being further enhanced.

For example, the combination of a crosslinking agent having a dendritic structure and a compound with formula (3) may be used as the crosslinking agent. The crosslinking agent may be obtained by the addition of a compound with formula (3) to the polymeric compound provided by the addition reaction between the compound with formula (1) and the compound with formula (2). Moreover, when, during the formation of the polymeric compound provided by the addition reaction between the compound with formula (1) and the compound with formula (2), the compound with formula (1) remains as an unreacted substance and this unreacted substance satisfies the conditions for formula (3), a crosslinking agent (crosslinking agent composition) can be obtained that contains the polymeric compound and the formula (3) compound that is this unreacted substance.

(3)

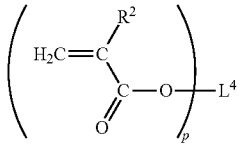

In formula (3), $R^2$ represents a hydrogen atom or an alkyl group having 1 to 4 carbon atoms; $L^4$ represents a p-valent linear or branched aliphatic hydrocarbon group optionally having a hydroxy group, or an ether bond-containing p-valent linear or branched aliphatic hydrocarbon group optionally having a hydroxy group; and p is an integer from 2 to 6.

$R^2$ in formula (3) preferably is a hydrogen atom or methyl group. Preferably $L^4$ represents a p-valent linear or branched aliphatic hydrocarbon group having 5 to 10 carbon atoms and possibly having a hydroxy group, or represents an ether bond-containing p-valent linear or branched aliphatic hydrocarbon group having 5 to 10 carbon atoms and possibly having a hydroxy group, and p is an integer from 3 to 6 (preferably 4 to 6).

The compound with formula (3) can be exemplified by ethylene glycol di(meth)acrylate, diethyl ene glycol di(meth)acrylate, triethylene glycol di(meth)acrylate, tetraethylene glycol di(meth)acrylate, tetramethylene glycol di(meth) acrylate, trimethylolpropane tri(meth)acrylate, trimethylolethane tri(meth)acrylate, pentaerythritol di(meth) acrylate, pentaerythritol tri(meth)acrylate, pentaerythritol tetra(meth)acrylate, dipentaerythritol penta(meth)acrylate, and dipentaerythritol hexa(meth)acrylate.

At least one selected from the group consisting of pentaerythritol tri(meth)acrylate, pentaerythritol tetra(meth) acrylate, dipentaerythritol penta(meth)acrylate, and dipentaerythritol hexa(meth)acrylate is preferred.

The content of the compound with formula (3) (unreacted multifunctional compound) in the crosslinking agent is preferably from 10 mass % to 50 mass % and is more preferably from 15 mass % to 40 mass %.

Known resins can be used without particular limitation as the binder resin. Examples in this regard are styrene acrylic resins, polyester resins, vinyl resins, polyol resins, phenolic resins, natural resin-modified phenolic resins, natural resin-modified maleic acid resins, silicone resins, polyurethane resins, polyamide resins, epoxy resins, and terpene resins.

Styrene-acrylic resins and polyester resins, which exhibit little environmental fluctuation in charging performance and exhibit an excellent fixing performance, are preferred among the preceding, while styrene acrylic resins are more preferred. Preferably the binder resin contains a styrene acrylic resin.

Polyester resin is a global term for resins in which the main chain skeleton has a repeat unit structure that contains the ester bond. For example, the condensation polymer of a polybasic carboxylic acid and a polyhydric alcohol is preferred.

With regard to the polymerizable monomer constituting the polyester resin, in conformity with the required polymer properties, polybasic carboxylic acids, which are the carboxylic acid components, and polyhydric alcohols, which are alcohol components, may be used alone or in combination of two or more.

The carboxylic acid component can be exemplified by unsaturated acids such as maleic acid, citraconic acid, itaconic acid, alkenylsuccinic acid, fumaric acid, and mesaconic acid, and by unsaturated acid anhydrides such as maleic anhydride, citraconic anhydride, itaconic anhydride, and alkenylsuccinic anhydride.

Additional examples for the saturated acids are phthalic anhydride, isophthalic acid, terephthalic acid, HET acid, succinic acid, adipic acid, azelaic acid, sebacic acid, tetrachlorophthalic anhydride, tetrabromophthalic anhydride, tetrahydrophthalic anhydride, and hexahydrophthalic anhydride.

The at least trifunctional polybasic carboxylic acids can be exemplified by trimellitic acid and pyromellitic acid and their anhydrides.

The alcohol component can be exemplified by ethylene glycol, propylene glycol, 1,4-butanediol, 1,3-butanediol, 2,3-butanediol, diethylene glycol, dipropylene glycol, triethylene glycol, 1,5-pentanediol, 1,6-hexanediol, neopentyl glycol, 2,2,4-trimethyl-1,3-pentanediol, hydrogenated bisphenol, pentaerythritol diallyl ether, glycerol, trimethylene glycol, 2-ethyl-1,3-hexanediol, phenyl glycidyl ether, and allyl glycidyl ether.

The polyester resin used for the binder resin preferably has an unsaturated bond capable of reacting with the crosslinking agent having a dendritic structure. An unsaturated bond can be introduced into the polymer main chain by carrying out condensation using an unsaturated acid or unsaturated acid anhydride in the carboxylic acid component. In addition, a vinyl group can be introduced in terminal position on the polyester molecule by using an acrylate or methacrylate ester such as 2-hydroxyethyl acrylate, 2-hydroxyethyl methacrylate, or 2-hydroxypropyl methacrylate or using a hydroxy group-bearing vinyl monomer such as 4-(1-hydroxy-1-methylbutyl)styrene or 4-(1-hydroxy-1-methylhexyl)styrene.

Of the resins, referred to as vinyl resins, obtained using a known radical polymerization procedure from polymerizable monomer having an ethylenically unsaturated bond such as the vinyl group, the styrene acrylic resins denote resins that contain at least 60 mass % of, e.g., a styrene resin obtained from styrenic polymerizable monomer, (meth) acrylic resin obtained from (meth)acrylic polymerizable monomer, copolymer from styrenic polymerizable monomer and (meth)acrylic polymerizable monomer, or styrene-(meth)acrylic resin that is a mixture of styrene resin and styrene acrylic resin.

When the binder resin is a styrene acrylic resin, the compatibility with microgel formed by a crosslinking agent having a dendritic structure is then very good and a toner is obtained that exhibits an excellent mechanical durability due to the occurrence of a suitable level of interaction, e.g., intermolecular entanglement.

The polymerizable monomer constituting the vinyl resin may be a single monofunctional polymerizable monomer or a combination of two or more monofunctional polymerizable monomers, or may be a combination of a monofunctional polymerizable monomer and a multifunctional polymerizable monomer, or may be a single multifunctional polymerizable monomer or a combination of two or more multifunctional polymerizable monomers.

The monofunctional polymerizable monomer can be exemplified by styrene and styrenic polymerizable monomers, e.g., α-methylstyrene, β-methylstyrene, o-methylstyrene, m-methylstyrene, p-methylstyrene, 2,4-dimethylstyrene, p-n-butyl styrene, p-tert-butyl styrene, p-n-hexyl styrene, p-n-octyl styrene, p-n-nonylstyrene, p-n-decylstyrene, p-n-dodecyl styrene, p-methoxystyrene, and p-phenylstyrene;

acrylic polymerizable monomers, e.g., methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers, e.g., methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The multifunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

Preferred among the preceding are polymers from a styrenic polymerizable monomer and at least one selected from the group consisting of acrylic polymerizable monomers and methacrylic polymerizable monomers. Thus, preferably the binder resin contains a copolymer from a crosslinking agent, a styrenic polymerizable monomer, and at least one selected from the group consisting of acrylic polymerizable monomers and methacrylic polymerizable monomers.

The method for producing the toner particle is not particularly limited and a known production method can be employed, while, for example, a dry production method, emulsion aggregation method, dissolution suspension method, or suspension polymerization method is preferred. Among these, methods in which a polymerizable monomer composition is granulated in an aqueous medium, such as the suspension polymerization method and emulsion polymerization method, are preferred. For example, a preferred toner production method has a step of obtaining the binder resin by the polymerization of a polymerizable monomer composition that contains crosslinking agent and polymerizable monomer that produces the binder resin.

A toner particle production method using suspension polymerization is described in the following.

A polymerizable monomer composition is prepared by effecting the uniform dissolution or dispersion, using a disperser such as a homogenizer, ball mill, colloid mill, or ultrasound disperser, of polymerizable monomer that will produce the binder resin and crosslinking agent and other, optional additives such as a release agent and a colorant, and dissolving therein a polymerization initiator. The toner particle is then produced by suspending this polymerizable monomer composition in an aqueous medium that contains a dispersion stabilizer and carrying out polymerization.

Thus, a preferred production method has a step of dispersing and granulating, in an aqueous medium, a polymerizable monomer composition containing polymerizable monomer that will produce the binder resin and a crosslinking agent, to form particles of the polymerizable monomer composition; and a step of copolymerizing the polymerizable monomer and crosslinking agent present in the particles of the polymerizable monomer composition to obtain toner particles.

The amount of use of the crosslinking agent, per 100 mass parts of the polymerizable monomer, is preferably 0.2 mass parts to 10.0 mass parts and is more preferably 0.5 mass parts to 5.0 mass parts.

The polymerization initiator may be added at the same time as the addition of the other additives to the polymerizable monomer or may be admixed immediately before suspension in the aqueous medium. The polymerization initiator dissolved in the polymerizable monomer or solvent may also be added immediately after granulation and before the start of the polymerization reaction.

A release agent may be used in the toner particle. Known release agents can be used without particular limitation as the release agent, but hydrocarbon waxes and ester waxes are preferred.

The following, for example, can be used as the hydrocarbon wax: polyolefins produced as low-molecular-weight by-products obtained during the polymerization of high-molecular-weight polyolefins; polyolefins provided by polymerization using a catalyst such as a Ziegler catalyst or a metallocene catalyst; paraffin waxes and Fischer-Tropsch waxes; synthetic hydrocarbon waxes synthesized by the Synthol method, hydrocol method, or Arge method using a coal gas or natural gas as starting material; synthetic waxes for which the monomer is a single-carbon compound; hydrocarbon waxes having a functional group such as the hydroxyl group or carboxy group; and mixtures of hydrocarbon waxes and functional group-bearing hydrocarbon waxes.

Also usable are waxes provided by subjecting the aforementioned waxes to a sharpening of the molecular weight distribution using a procedure such as, for example, a press sweating method, solvent method, vacuum distillation method, supercritical gas extraction method, or melt crystallization, as well as waxes provided by the removal of low-molecular-weight solid fatty acids, low-molecular-weight solid alcohols, low-molecular-weight solid compounds, and other impurities.

The ester wax should have at least one ester bond per molecule, and a natural wax or a synthetic wax may be used.

The synthetic ester waxes can be exemplified by esters between a linear aliphatic acid and a linear aliphatic alcohol and can be more specifically exemplified by monoester waxes synthesized from a long-chain linear saturated fatty acid and a long-chain linear saturated alcohol.

A long-chain linear saturated fatty acid given by the general formula $C_nH_{(2n+1)}COOH$ wherein n=5 to 28 is preferably used. In addition, a long-chain linear saturated alcohol given by $C_nH_{(2n+1)}OH$ wherein n=5 to 28 is preferably used.

The long-chain linear saturated fatty acid can be specifically exemplified by capric acid, undecylic acid, lauric acid, tridecylic acid, myristic acid, palmitic acid, pentadecylic acid, heptadecanoic acid, tetradecanoic acid, stearic acid, nonadecanoic acid, arachidic acid, behenic acid, lignoceric acid, cerotic acid, heptacosanoic acid, montanic acid, and melissic acid.

The long-chain linear saturated alcohol can be specifically exemplified by amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol.

Ester waxes having two or more ester bonds per molecule can be exemplified by ester waxes having from 2 to 8 functional groups, that is, esters between a dihydric to octahydric alcohol and an aliphatic carboxylic acid and esters between a dibasic to octabasic carboxylic acid and an aliphatic alcohol. Specific examples are trimethylolpropane tribehenate, pentaerythritol tetrabehenate, pentaerythritol diacetate dibehenate, glycerol tribehenate, 1,18-octadecanediol bisstearate, and the like; and polyalkanol esters (tristearyl trimellitate and distearyl maleate).

The molecular weight of the wax is preferably not more than 2,500. When the molecular weight of the wax is in this range, the molecular size (extent of the molecular chain) is then not too large, and as a consequence at least a certain diffusion rate can be maintained and the wax can then readily permeate out during fixing.

The content of the wax incorporated in the toner is preferably from 1 mass % to 30 mass %. When the wax content is in this range, the wax then assumes a favorable proportion in the toner as a whole, which facilitates the generation of excellent results for fixing when the toner is fixed.

The melting point of the wax used for the present invention is preferably in the range from 60° C. to 120° C. and is more preferably in the range from 65° C. to 100° C.

Only a single species of wax may be used or a combination of a plurality of species may be used.

The following organic pigments, organic dyes, and inorganic pigments may be used as a colorant in the toner particle.

Cyan colorants can be exemplified by copper phthalocyanine compounds and derivatives thereof, anthraquinone compounds, and basic dye lake compounds. The following are specific examples:

C. I. Pigment Blue 1, 7, 15, 15:1, 15:2, 15:3, 15:4, 60, 62, and 66.

The following are examples of magenta colorants: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. The following are specific examples:

C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, and 254, and C. I. Pigment Violet 19.

Yellow colorants can be exemplified by condensed azo compounds, isoindolinone compounds, anthraquinone compounds, azo-metal complexes, methine compounds, and allylamide compounds. The following are specific examples:

C. I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Black colorants can be exemplified by carbon black and by black colorants provided by color mixing using the aforementioned yellow colorants, magenta colorants, and cyan colorants to give a black color.

These colorants may be used alone or as a mixture, and these colorants may also be used in a solid solution state. The colorant is selected considering the hue angle, chroma, lightness, lightfastness, OHP transparency, and dispersibility in the toner particle.

The colorant is preferably used at from 1.0 mass parts to 20.0 mass parts per 100.0 mass parts of the binder resin.

When the toner particle is obtained using the suspension polymerization method, the use is preferred, considering the polymerization-inhibiting activity and aqueous phase transferability possessed by colorants, of a colorant on which a hydrophobic treatment has been executed using a substance that does not inhibit polymerization. In an example of a preferred method for executing a hydrophobic treatment on a dye, a colored polymer is preliminarily prepared by polymerizing the polymerizable monomer in the presence of the dye and the resulting colored polymer is added to the polymerizable monomer composition.

In the case of carbon black, in addition to a hydrophobic treatment as described above for a dye, a treatment may be carried out with a substance (polyorganosiloxane) that reacts with the surface functional groups on carbon black.

A charge control agent may be used on an optional basis. A known charge control agent can be used as the charge control agent, wherein a charge control agent that provides a fast triboelectric charging speed and that can maintain a defined and stable triboelectric charge quantity is particularly preferred. When the toner particle is produced by the suspension polymerization method, a charge control agent that exercises little polymerization inhibition and that is substantially free of material soluble in the aqueous medium is particularly preferred.

The charge control agents include those that control the toner to negative charging and those that control the toner to positive charging. Charge control agents that control the toner to negative charging can be exemplified by monoazo metal compounds; acetylacetone-metal compounds; metal compounds of aromatic oxycarboxylic acids, aromatic dicarboxylic acids, oxycarboxylic acids, and dicarboxylic acids; aromatic oxycarboxylic acids, aromatic monocarboxylic acids, and aromatic polycarboxylic acids and their metal salts, anhydrides, and esters; phenol derivatives such as bisphenol; urea derivatives; metal-containing salicylic acid compounds; metal-containing naphthoic acid compounds; boron compounds; quaternary ammonium salts; calixarene; and charge control resins.

Charge control agents that control the toner to positive charging, on the other hand, can be exemplified by the following: guanidine compounds; imidazole compounds; quaternary ammonium salts such as tributylbenzylammonium 1-hydroxy-4-naphthosulfonate and tetrabutylammonium tetrafluoroborate, and their onium salt analogues, such as phosphonium salts, and their lake pigments; triphenylmethane dyes and their lake pigments (the laking agent is exemplified by phosphotungstic acid, phosphomolybdic acid, phosphomolybdotungstic acid, tannic acid, lauric acid, gallic acid, ferricyanides, and ferrocyanides); metal salts of higher fatty acids; and charge control resins.

These charge control agents may be added alone or in combination of two or more.

Among these charge control agents, metal-containing salicylic acid compounds are preferred and metal-containing salicylic acid compounds in which the metal is aluminum or zirconium are particularly preferred.

The amount of addition of the charge control agent, per 100.0 mass parts of the binder resin, is preferably from 0.01 mass parts to 20.0 mass parts and is more preferably from 0.5 mass parts to 10.0 mass parts.

A polymer or copolymer having a sulfonic acid group, sulfonate salt group, or sulfonate ester group is preferably used for the charge control resin. The polymer having a sulfonic acid group, sulfonate salt group, or sulfonate ester group particularly preferably contains at least 2 mass %, as the copolymerization ratio, of a sulfonic acid group-containing acrylamide-type monomer or sulfonic acid group-containing methacrylamide-type monomer, and more preferably contains at least 5 mass % of same.

The charge control resin preferably has a glass transition temperature (Tg) from 35° C. to 90° C., a peak molecular weight (Mp) from 10,000 to 30,000, and a weight-average molecular weight (Mw) from 25,000 to 50,000. When this is used, preferred triboelectric charging characteristics can be conferred without exercising an influence on the thermal characteristics required of the toner particle. Moreover, because the charge control resin contains a sulfonic acid group, for example, the dispersibility of the charge control resin itself in the colorant dispersion and the dispersibility of the colorant are improved and the tinting strength, transparency, and triboelectric charging characteristics can then be further improved.

A polymerization initiator may be used in order to polymerize the polymerizable monomer. The polymerization initiator can be exemplified by organoperoxide-type initiators and azo-type initiators. The organoperoxide-type initiators can be exemplified by the following:

benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl peroxypivalate.

The azo-type polymerization initiators are exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile.

A redox initiator, comprising the combination of an oxidizing substance with a reducing substance, may also be used as the polymerization initiator. The oxidizing substance can be exemplified by inorganic peroxides such as hydrogen peroxide and persulfate salts (sodium salt, potassium salt, and ammonium salt) and by oxidizing metal salts such as tetravalent cerium salts.

The reducing substance can be exemplified by reducing metal salts (divalent iron salts, monovalent copper salts, and trivalent chromium salts); ammonia; amino compounds such as lower amines (amines having from 1 to about 6 carbon atoms, such as methylamine and ethylamine) and hydroxylamine; reducing sulfur compounds such as sodium thiosulfate, sodium hydrosulfite, sodium bisulfite, sodium sulfite, and sodium formaldehyde sulfoxylate; lower alcohols (from 1 to 6 carbon atoms); ascorbic acid and its salts; and lower aldehydes (from 1 to 6 carbon atoms).

The polymerization initiator is selected considering its 10-hour half-life decomposition temperature, and may be used alone or as a mixture. The amount of addition of the polymerization initiator will vary with the desired degree of polymerization, but generally from 0.5 mass parts to 20.0 mass parts is added per 100.0 mass parts of the polymerizable monomer.

A known chain transfer agent and polymerization inhibitor may also be added and used in order to control the degree of polymerization.

The known inorganic compound dispersion stabilizers and organic compound dispersion stabilizers can be used as the dispersion stabilizer used in the preparation of the aqueous medium. The inorganic compound dispersion stabilizers can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina.

The following, on the other hand, are examples of organic compound dispersion stabilizers: polyvinyl alcohol, gelatin, methyl cellulose, methyl hydroxypropyl cellulose, ethyl cellulose, the sodium salt of carboxymethyl cellulose, polyacrylic acid and salts thereof, and starch. These dispersion stabilizers are preferably used in an amount from 0.2 mass parts to 20.0 mass parts per 100.0 mass parts of the polymerizable monomer.

When, among these dispersion stabilizers, an inorganic compound dispersion stabilizer is used, a commercially available inorganic compound dispersion stabilizer may be directly used as such; however, the inorganic compound may be produced in the aqueous medium in order to obtain a dispersion stabilizer having an even finer particle diameter. For example, in the case of tricalcium phosphate, it may be obtained by mixing an aqueous sodium phosphate solution with an aqueous calcium chloride solution under high speed stirring.

The toner particle may be used as such as a toner, or an external additive may be externally added to the toner particle in order to impart various properties to the toner. External additives for bringing about an enhanced toner flowability can be exemplified by inorganic fine particles such as silica fine particles, titanium oxide fine particles, and composite oxide fine particles thereof. Silica fine particles and titanium oxide fine particles are preferred among inorganic fine particles.

For example, a toner may be obtained by externally adding inorganic fine particles to the toner particle and mixing in order to attach the inorganic fine particles to the toner particle surface. A known method may be adopted for the method of carrying out the external addition of the inorganic fine particles. For example, a mixing process may be carried out using a Henschel mixer (Mitsui Miike Chemical Engineering Machinery Co., Ltd.).

The silica fine particles can be exemplified by the dry silica and fumed silica produced by the vapor-phase oxidation of a silicon halide, and by the wet silica produced from water glass. Dry silica is preferred for the inorganic fine particles because dry silica contains little of the silanol group present on the surface and in the interior of silica fine particles and contains little $Na_2O$ and $SO_3^{2-}$. The dry silica may be a composite fine particle of silica and another metal oxide as obtained by the use in the production process of a silicon halide compound in combination with another metal halide compound such as, for example, aluminum chloride or titanium chloride.

Adjustment of the triboelectric charge quantity on the toner, an improved environmental stability, and an enhanced flowability in a high-temperature, high-humidity environment can be achieved through a hydrophobic treatment of the surface of the inorganic fine particles with a treatment agent, and the use of hydrophobically treated inorganic fine particles is thus preferred. When the inorganic fine particles that have been externally added to the toner are hygroscopic, the triboelectric charge quantity and flowability of the toner are reduced, facilitating reductions in the developing performance and transferability.

The treatment agent for hydrophobically treating the inorganic fine particles can be exemplified by unmodified silicone varnishes, variously modified silicone varnishes, unmodified silicone oils, variously modified silicone oils, silane compounds, silane coupling agents, other organosilicon compounds, and organotitanium compounds. Silicone oils are preferred among the preceding. These treatment agents may be used alone or in combination.

The total amount of inorganic fine particle addition, per 100.0 mass parts of the toner particle, is preferably from 1.0 mass parts to 5.0 mass parts and is more preferably from 1.0 mass parts to 2.5 mass parts. Viewed from the standpoint of durability when added to the toner, the external additive preferably has a particle diameter that is not more than one-tenth of the average particle diameter of the toner particle.

The methods used to measure the various properties pertaining to the present invention are described in the following.

Measurement of Amount of THF-Insoluble Matter

The amounts of the THF-insoluble matter A and THF-insoluble matter B in the resin were measured proceeding as follows.

Extraction of the THF-insoluble matter A is carried out first. Approximately 1.0 g of the binder resin is exactly weighed (W0 [g]) and is introduced into a pre-weighed extraction thimble (product name: No. 84, size 40×150 mm, Advantec Toyo Kaisha, Ltd.), which is a filter having an average pore diameter of 8 and this is set into a Soxhlet extractor. Extraction is carried out for 16 hours using 400 mL of THF as solvent. During this process, the heating temperature is adjusted so the extraction is run at a reflux rate that provides an extraction solvent cycle of once in approximately 5 minutes, and stirring is performed during the extraction so the swollen resin fraction in the extraction thimble does not stick.

After the completion of the extraction, the thimble is removed and is air dried, followed by vacuum drying for 8 hours at 40° C. and weighing the mass of the thimble including the extraction residue. The mass of the thimble provided by the initial pre-weighing is subtracted from the mass of the thimble including the extraction residue to give the mass of the THF-insoluble matter A (WA [g]).

The mass % of the THF-insoluble matter A in the binder resin is calculated as follows.

$$\text{THF-insoluble matter } A \text{ (mass \%)} = WA/W0 \times 100$$

Extraction of the THF-insoluble matter B is then performed. The extraction solution provided by the THF-insoluble matter A extraction process is taken to a 2 L roundbottom ground glass flask and the total amount is brought to about 800 mL by the addition of THF. A condenser is installed and stirring is carried out for 24 hours at 50° C. under reflux.

Then, using a pressure filter, passage through a pre-weighed filter having an average pore diameter of 0.8 μm (0.8-μm PTFE membrane filter, 90 mm size, Advantec Toyo Kaisha, Ltd.) is carried out, and the filter and THF-insoluble matter on the filter are washed by passing 200 mL of THF, preheated to 50° C., through the filter three times.

After the completion of filtration, the filter paper is removed and is air dried, followed by vacuum drying for 8 hours at 40° C. and weighing the mass of the filter paper including the extraction residue. The mass of the filter paper provided by the initial pre-weighing is subtracted from the mass of the filter paper including the extraction residue to give the mass of the THF-insoluble matter B (WB [g]).

$$\text{THF-insoluble matter } B \text{ (mass \%)} = WB/W0 \times 100$$

These filtration processes and the calculation of each THF-insoluble matter were carried out at least 5 times or more, the largest and smallest values were discarded, and the resulting average value was taken to be the value of the particular THF-insoluble matter.

The amounts of the THF-insoluble matter A and THF-insoluble matter B using the toner are measured proceeding as follows. In comparison to the method for the quantitative measurement of the THF-insoluble matter from the binder resin, a release agent, colorant, and external additive may be admixed when the toner is used.

Using the toner as the sample, a filtrate for the filter having an average pore diameter of 0.8 μm is obtained proceeding as described above. The resulting filtrate is concentrated followed by air drying in a Teflon (registered trademark) dish and then vacuum drying for 8 hours at 40° C. to obtain a resin mixture. The quantities of the release agent, colorant, and external additive in the resin mixture are analyzed and compared to their contents in the toner. When a difference occurs, the quantities of the release agent, colorant, and external additive contained in the THF-insoluble matter are analyzed, and the quantities of the THF-insoluble matter A and THF-insoluble matter B are obtained by subtracting these fractions from the THF-insoluble matter. Known analytic methods may be used for the quantitative determination of the release agent, colorant, and external additive, but the following methods are provided as examples.

The release agent can be quantitated using nuclear magnetic resonance spectroscopic analysis ($^1$H-NMR) after extraction with chloroform or hexane.

In the case of a cyan colorant, quantitation can be carried out based on the amount of Cu using x-ray fluorescence analysis. For other pigments, the pigment can be identified using, e.g., elementary analysis or pyrolysis GC-MS, followed by quantitation of the content using a UV absorbance calibration curve.

The external additive can be quantitated by x-ray fluorescence analysis.

Measurement of Weight-Average Molecular Weight (Mw) of Crosslinking Agent

The weight-average molecular weight (Mw) of the crosslinking agent is measured using gel permeation chromatography (GPC) as follows.

First, the crosslinking agent is dissolved in tetrahydrofuran at room temperature for 24 hours. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of approximately 0.8 mass %. Measurement is carried out under the following conditions using this sample solution.

instrument: HLC8120 GPC (detector: RI) (Tosoh Corporation)

column: 7-column train of Shodex KF-801, 802, 803, 804, 805, 806, and 807

(Showa Denko Kabushiki Kaisha)

eluent: tetrahydrofuran (THF)

flow rate: 1.0 mL/min oven temperature: 40.0° C.

sample injection amount: 0.10 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Calculation of Number of Crosslinking Functional Groups (Number of Vinyl Groups)

The number of vinyl groups per 1 molecule of the crosslinking agent is calculated from the weight-average molecular weight (Mw) provided by gel permeation chromatography (GPC) and a determination of the vinyl group by the internal reference method using nuclear magnetic resonance spectroscopic analysis ($^1$H-NMR).

A known reagent is used for the vinyl group reference sample; a calibration curve is constructed of the concentration ratio with the internal reference substance-versus-the integration value ratio; and, using the calibration curve, the vinyl group is determined from NMR measurement of the crosslinking agent added in the internal reference method.

measurement instrument: JNM-EX400 FT-NMR instrument (JEOL Ltd.)
measurement frequency: 400 MHz
pulse condition: 5.0 μs
frequency range: 10,500 Hz
number of scans: 64
measurement solvent: $CDCl_3$ The number of vinyl groups per 1 molecule is taken to be the value determined with the following formula using the value from this determination and the weight-average molecular weight (Mw) provided by GPC.

number of vinyl groups ($N$) per 1 molecule=molality of vinyl groups (mol/kg) according to the NMR determination×weight-average molecular weight (Mw) by GPC/1000

When a plurality of vinyl group species (for example, styryl group, acryloyl group, methacryloyl group) are present in 1 molecule of the crosslinking agent, the number of each is calculated and the sum is used for the number of vinyl groups.

Method for Measuring Weight-Average Particle Diameter (D4) of Toner

A "Coulter Counter Multisizer 3" (registered trademark, Beckman Coulter, Inc.), a precision particle size distribution measurement instrument operating on the pore electrical resistance method and equipped with a 100-μm aperture tube, is used for the weight-average particle diameter (D4) of the toner. Using the accompanying dedicated software, i.e., "Beckman Coulter Multisizer 3 Version 3.51" (Beckman Coulter, Inc.), to set the measurement conditions and analyze the measurement data, the measurement is carried out in 25,000 channels for the number of effective measurement channels and the measurement data is analyzed.

The aqueous electrolyte solution used for the measurements is prepared by dissolving special-grade sodium chloride in deionized water to provide a concentration of 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte solution is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the analysis software.

(2) 30 mL of the aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), an ultrasound disperser having an electrical output of 120 W and equipped with two oscillators (oscillation frequency=50 kHz) disposed such that the phases are displaced by 180°, and 2 mL of Contaminon N is added to the water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

EXAMPLES

The present invention is more specifically described in the following using examples. The present invention is not limited by the examples that follow. The number of parts in the examples and comparative examples is on a mass basis in all instances unless specifically indicated otherwise.

Production of Crosslinking Agents Having Dendritic Structure Production of Crosslinking Agent 1

230 g of propylene glycol monomethyl ether, 20 g of pentaerythritol tetra(mercaptoacetate), 220 g of a mixture of dipentaerythritol hexaacrylate and dipentaerythritol pentaacrylate (M-402, Toagosei Co., Ltd.), 0.1 g of hydroquinone, and 0.01 g of benzyldimethylamine were added to a 1-L four-neck flask, and a reaction was run for 14 hours at 60° C. to give crosslinking agent 1.

Analysis of crosslinking agent 1 gave the following: total number of vinyl groups, e.g., acryloyl group and methacryloyl group, per 1 molecule (also referred to hereafter simply as the "number of vinyl groups")=110, mixture of unreacted dipentaerythritol hexaacrylate and dipentaerythritol pentaacrylate=30 mass %.

Production of Crosslinking Agents 2 to 8

Crosslinking agents 2 to 8 were obtained using the same production method as for crosslinking agent 1, but changing the starting materials and number of parts of addition as shown in Table 1.

The multifunctional (meth)acrylate compound used for crosslinking agent 3 is a mixture of dipentaerythritol hexaacrylate and dipentaerythritol pentaacrylate (M-400, Toagosei Co., Ltd.).

The multifunctional (meth)acrylate compound used for crosslinking agent 4 is a mixture of pentaerythritol tetraacrylate and pentaerythritol triacrylate (M-305, Toagosei Co., Ltd.).

TABLE 1

| | Multifunctional (meth)acrylate compound | Polyvalent mercapto compound | Mercapto compound (for adjustment of number of vinyl groups) | Mw | Number of vinyl groups | X (mass %) | Presence/ Absence of dendritic structure |
|---|---|---|---|---|---|---|---|
| Crosslinking agent 1 | dipentaerythritol hexaacrylate/ dipentaerythritol pentaacrylate | 220 g PTM 20 g | — — | 13000 | 110 | 30 | Present |
| Crosslinking agent 2 | pentaerythritol tetraacrylate | 180 g TTM 25 g | — — | 4400 | 20 | 10 | Present |
| Crosslinking agent 3 | dipentaerythritol hexaacrylate/ dipentaerythritol pentaacrylate | 260 g PTM 40 g | sec-butyl mercaptan 2 g | 46000 | 125 | 20 | Present |
| Crosslinking agent 4 | pentaerythritol tetraacrylate/ pentaerythritol triacrylate | 160 g TTM 25 g | — — | 3600 | 18 | 10 | Present |
| Crosslinking agent 5 | dipentaerythritol hexaacrylate | 260 g DHM 30 g | sec-butyl mercaptan 5 g | 54000 | 150 | 40 | Present |
| Crosslinking agent 6 | pentaerythritol tetraacrylate | 190 g TTM 25 g | sec-butyl mercaptan 0.3 g | 4700 | 13 | 10 | Present |
| Crosslinking agent 7 | pentaerythritol tetraacrylate | 190 g TTM 25 g | sec-butyl mercaptan 0.5 g | 4800 | 9 | 10 | Present |
| Crosslinking agent 8 | pentaerythritol tetraacrylate | 260 g TTM 25 g | sec-butyl mercaptan 0.5 g | 6000 | 30 | 50 | Present |

In the table
X indicates "Amount of unreacted multifunctional compound",
PTM indicates "pentaerythritol tetra(mercaptoacetate)",
TTM indicates "trimethylolpropane tri(mercaptoacetate)", and
DHM indicates "dipentaerythritol hexa(mercaptoacetate)".

Production of Crosslinking Agents 9 and 10

A 2-L four-neck flask was fitted with a nitrogen introduction line; 500 g of tetrahydrofuran (THF) and 500 g of a 10% solution of a third generation PAMAM dendrimer (amino surface groups) (Sigma-Aldrich), for which the solvent had been preliminarily exchanged for THF, were added; and stirring was carried out for 1 hour on an ice bath while introducing nitrogen and the temperature was made constant. Then, 23 g of methacryloyl chloride was slowly added dropwise from a dropping funnel, and stirring was carried out for 1 hour on an ice bath after the completion of dropwise addition. A reaction was subsequently run by stirring for 24 hours at room temperature under a nitrogen current. After the completion of the reaction, the solvent was exchanged for toluene to yield crosslinking agent 9. The concentration of crosslinking agent 9 was 50%, its weight-average molecular weight (Mw) was 8,800, and the number of vinyl groups per 1 molecule was 28.

Crosslinking agent 10 was obtained using the same production method as for crosslinking agent 9, but using a fourth generation PAMAM dendrimer (amino surface groups) (Sigma-Aldrich) for the dendrimer used. The concentration of crosslinking agent 10 was 50%, its weight-average molecular weight (Mw) was 18,000, and the number of vinyl groups was 55.

Production of Crosslinking Agents 11 and 12

Monomer 11: Synthesis of N,N-Diethyldithiocarbamylmethylstyrene

A nitrogen introduction line and reflux condenser were fitted on a 2-L four-neck flask; 120 g of chloromethylstyrene, 180 g of sodium N,N-diethyldithiocarbamate trihydrate, and 1500 g of acetone were added; and a reaction was run by stirring for 1 hour at 40° C. while introducing nitrogen. After the completion of the reaction, the precipitated sodium chloride was filtered off and the acetone was then distilled from the reaction solution using an evaporator. The product was subsequently redissolved in toluene and separatory purification was performed using a toluene/aqueous system, followed by recrystallization from toluene at −20° C. The crystals were filtered off and vacuum dried to yield N,N-diethyldithiocarbamylmethyl styrene.

Monomer 12: Synthesis of N,N-Diethyldithiocarbamyl Ethyl Methacrylate

The synthesis was carried out by the same method as the method described above for the synthesis of N,N-diethyldithiocarbamylmethylstyrene, but changing the monomer from chloromethylstyrene to 100 g of chloroethyl methacrylate and changing the reaction time to 15 hours. Using 1,2-dichloroethane for the recrystallization solvent after distillative removal of the acetone, the work up was carried out as in the synthesis method described above to obtain the target N,N-diethyldithiocarbamylethyl methacrylate.

Production of Crosslinking Agent 11

110 g of monomer 11 and 70 g of toluene were added to the flask of a 300-mL laboratory photochemical reactor (Ushio Inc.) and stirring was carried out and the interior of the reaction system was substituted with nitrogen. A high-pressure mercury lamp (Ushio UM-102, 100 W, Ushio Inc.) was placed in the cooled light source well at the center of this laboratory photochemical reactor and the lamp was turned on and a photopolymerization reaction was run for 12 hours at 25° C. After the completion of the polymerization reaction, a reprecipitation purification using methanol as the precipitant and THF as the good solvent was performed twice. This was followed by filtration and then vacuum drying in a Teflon (registered trademark) dish to obtain a dithiocarbamate group-bearing crosslinking agent precursor 11.

A nitrogen introduction line and reflux condenser were fitted on a 1-L four-neck flask; 30 g of the dithiocarbamate group-bearing crosslinking agent precursor 11 and 300 g of 1,4-dioxane were added; and stirring was carried out for 1 hour while introducing nitrogen. 300 g of hydrazine monohydrate was then added and a reaction was run under reflux for 3 days under a nitrogen current. After then cooling to room temperature, the lower layer of the solution, which had separated into two layers, was removed; a saturated aqueous sodium chloride solution was added to the resulting solution and the organic solvent layer was washed; and drying was carried out over anhydrous magnesium sulfate. The solution was concentrated and a reprecipitation purification using chloroform as the good solvent and n-hexane as the precipitant was performed twice. The resulting colorless powder was dried to yield a thiol group-bearing crosslinking agent precursor 11, provided by the conversion of the dithiocarbamate group to the thiol group.

20 g of the thiol group-bearing crosslinking agent precursor 11, 100 g of toluene, 12 g of divinylbenzene, 3 g of styrene, 0.05 g of hydroquinone, and 0.001 g of benzyldimethylamine were added to a 300-mL four-neck flask, and a reaction was run for 14 hours at 60° C. to obtain crosslinking agent 11. Analysis of crosslinking agent 11 gave a weight-average molecular weight (Mw) of 29,000 and 62 for the number of vinyl groups. The unreacted divinylbenzene was 0, which was the detection limit.

Production of Crosslinking Agent 12

100 g of monomer 12 and 100 g of toluene were added to the flask of a 300-mL laboratory photochemical reactor (Ushio Inc.) and stirring was carried out and the interior of the reaction system was substituted with nitrogen. A high-pressure mercury lamp (Ushio UM-102, 100 W, Ushio Inc.) was placed in the cooled light source well at the center of the laboratory photochemical reactor and the lamp was turned on and a photopolymerization reaction was run for 6 hours at 25° C. After the completion of the polymerization reaction, a reprecipitation purification using methanol as the precipitant and THF as the good solvent was performed twice. This was followed by filtration and then vacuum drying in a Teflon (registered trademark) dish to obtain a dithiocarbamate group-bearing crosslinking agent precursor 12.

Using the same production method as for crosslinking agent 11, the dithiocarbamate group-bearing crosslinking agent precursor 12 was reacted to convert the dithiocarbamate group into the thiol group and provide the thiol group-bearing crosslinking agent precursor 12.

20 g of the thiol group-bearing crosslinking agent precursor 12, 100 g of toluene, 10 g of ethylene glycol dimethacrylate, 5 g of methyl methacrylate, 0.05 g of hydroquinone, and 0.001 g of benzyldimethylamine were added to a 300-mL four-neck flask, and a reaction was run for 14 hours at 60° C. to obtain crosslinking agent 12. Analysis of crosslinking agent 12 gave a weight-average molecular weight (Mw) of 47,000 and 70 for the number of vinyl groups. The unreacted ethylene glycol dimethacrylate was 0, which was the detection limit.

Production of Crosslinking Agents not Having Dendritic Structure Crosslinking Agents 13 to 15

The crosslinking agents given in Table 2 were used for crosslinking agents 13 to 15.

TABLE 2

| | Multifunctional (meth)acrylate compound | |
|---|---|---|
| Crosslinking agent 13 | 1,6-hexanediol diacrylate | Tokyo Chemical Industry Co., Ltd. |
| Crosslinking agent 14 | pentaerythritol tetraacrylate | Shin-Nakamura Chemical Co., Ltd. |
| Crosslinking agent 15 | dipentaerythritol hexaacrylate | Shin-Nakamura Chemical Co., Ltd. |
| Crosslinking agent 16 | mixture of Crosslinking agent 1: 100 parts and Crosslinking agent 14: 130 parts | |

Production of Compounds Used in Toner Production

Production of Compound 1

A starburst dendrimer was synthesized with reference to Japanese Patent Application Laid-open No. H07-219272. The monomer and solvent used for the anionic polymerization were first dried and purified. 500 g of the toluene solvent was added to a 2-L three-neck flask, the interior walls of which had been dried using a heat gun, and 0.3 g of the n-butyllithium initiator was then added and stirring was carried out while cooling with dry ice/acetone.

24 g of purified styrene was then added while cooling and the temperature was brought to 0° C. with stirring for 2 hours and polymerization was carried out. Then, while recooling with dry ice/acetone, 23 g of purified isoprene was added and a reaction was run for 6 hours while stirring at 0° C. 20 g of methacryloyl chloride was finally added and stirring was carried out for 1 hour and the reaction was completed once the color of the anion was extinguished. The solution was subjected to reprecipitation purification 5 times using methanol as the precipitant and toluene as the good solvent. Filtration and subsequent vacuum drying gave a macromonomer.

10 g of the obtained macromonomer, 10 g of ethylene glycol dimethacrylate, 50 mg of AIBN as initiator, and 100 g of toluene as solvent were added to a 200-mL three-neck flask and thorough stirring and nitrogen substitution were carried out. The vessel was closed airtight and a radical polymerization was then run for 24 hours at 60° C. After the reaction was finished, reprecipitation purification was performed twice using methanol as the precipitant and toluene as the good solvent. Filtration and subsequent vacuum drying gave a starburst dendrimer designated as compound 1.

Production of Compound 2

Crosslinked polymer fine particles were synthesized with reference to Japanese Patent Application Laid-open No. S63-309967.

A nitrogen introduction line and reflux condenser were fitted on a 500-mL four-neck flask; 300 g of deionized water, 3.5 g of sodium lauryl sulfate, 27.0 g of styrene, and 3.0 g of divinylbenzene were added; and stirring was carried out for 30 minutes at 70° C. while bubbling with nitrogen. An aqueous solution of 0.5 g of 2,2'-azobis(2-methylpropionamidine) dihydrochloride as initiator dissolved in 15 g of water was then introduced and a reaction was run for 24 hours under a nitrogen atmosphere.

After the reaction was finished, a portion of the obtained reaction solution was sampled out for measurement of the particle diameter, while the remainder was purified twice by centrifugal separation using methanol as the solvent to obtain 300 g of a methanol dispersion containing 10% solids in the form of crosslinked polymer fine particles designated as compound 2. The obtained methanol dispersion was subsequently mixed with 1 L of styrene and only the methanol was then removed by distillation to obtain a compound 2 solution in the form of a 50% styrene solution of compound 2.

Using a Nano-ZS Zetasizer (Malvern) and the aqueous sample solution referenced above, the particle diameter on a volume basis was measured for compound 2, i.e., crosslinked polymer fine particles; the result was 90 nm.

Toner 1 Production

An aqueous medium was prepared by adding 9.0 parts of tricalcium phosphate to 1300.0 parts of deionized water heated to a temperature of 60° C. and stirring at a stirring rate of 15,000 rpm using a T. K. Homomixer (Tokushu Kika Kogyo Co., Ltd.).

In addition, a mixture was prepared by mixing the following binder resin starting materials while stirring at a stirring rate of 100 rpm using a propeller-type stirrer.

| | |
|---|---|
| styrene | 75.0 parts |
| n-butyl acrylate | 25.0 parts |
| crosslinking agent 1 | 1.4 parts |

The following were then added to the resulting solution.

| | |
|---|---|
| cyan colorant (C. I. Pigment Blue 15:3) | 6.5 parts |
| negative charge control agent (Bontron E-84, Orient Chemical Industries Co., Ltd.) | 0.5 parts |
| hydrocarbon wax (Tm = 78° C.) | 10.0 parts |
| polyester resin | 5.0 parts |

(condensate of bisphenol A-2 mol propylene oxide adduct/terephthalic acid/trimellitic acid, glass transition temperature: 75° C.)

The mixture was then heated to a temperature of 65° C. and a polymerizable monomer composition was subsequently prepared by dissolving and dispersing with stirring at a stirring rate of 10,000 rpm using a T. K. Homomixer (Tokushu Kika Kogyo Co., Ltd.).

The polymerizable monomer composition was then introduced into the aforementioned aqueous medium;

Perbutyl PV (10-hour half-life decomposition temperature=54.6° C. (NOF Corporation)) 10.0 parts was added as polymerization initiator; and granulation was performed by stirring at a temperature of 70° C. for 20 minutes at a stirring rate of 15,000 rpm using a T. K. Homomixer.

The stirrer was changed over to a propeller-type stirrer and, while stirring at a stirring rate of 200 rpm, a polymerization reaction was run on the styrene and n-butyl acrylate, which were the polymerizable monomers in the polymerizable monomer composition, for 5 hours at a temperature of 85° C. to produce a toner particle-containing slurry. The slurry was cooled when the polymerization reaction was finished. Hydrochloric acid was added to the cooled slurry to bring the pH to 1.4 and the calcium phosphate salt was dissolved by stirring for 1 hour. The slurry was then washed with 10-fold water and filtered and dried, and the particle diameter was subsequently adjusted by classification to obtain a toner particle.

1.5 parts of hydrophobic silica fine particles (primary particle diameter: 7 nm, BET specific surface area: 130 $m^2/g$), which had been treated with dimethylsilicone oil at 20 mass % with reference to the silica fine particles, was mixed as external additive with 100.0 parts of the aforementioned toner particle for 15 minutes at a stirring rate of 3,000 rpm using a Mitsui Henschel mixer (Mitsui Miike Chemical Engineering Machinery Co., Ltd.) to obtain a toner 1.

Measurement of the particle diameter of the toner particle in toner 1 using the previously described particle size distribution analyzer based on the Coulter principle (Coulter Multisizer III, Coulter Corporation) gave a weight-average particle diameter (D4) of 5.9 μm.

The THF-insoluble matter A was 5 mass %, the THF-insoluble matter B was 35 mass %, and the degree of THF swelling of the THF-insoluble matter B was 5.0. The properties are given in Table 3.

Toners 2 to 16 and 19 to 24 Production

Toners 2 to 16 and toners 19 to 24 were obtained using the same production method as for toner 1, but changing the starting materials and the number of parts of addition as shown in Table 3. The properties of the obtained toners are given in Table 3.

Toner 25 Production

An aqueous medium was prepared by adding 9.0 mass parts of tricalcium phosphate to 1300.0 mass parts of deionized water heated to a temperature of 60° C. and stirring at a stirring rate of 15,000 rpm using a T. K. Homomixer (Tokushu Kika Kogyo Co., Ltd.).

In addition, a mixture was prepared by mixing the following binder resin starting materials while stirring at a stirring rate of 100 rpm using a propeller-type stirrer.

| | |
|---|---|
| styrene | 52.5 parts |
| n-butyl acrylate | 17.5 parts |
| compound 1 | 30.0 parts |

The following were then added to the resulting solution.

| | |
|---|---|
| cyan colorant (C. I. Pigment Blue 15:3) | 6.5 parts |
| negative charge control agent (Bontron E-84, Orient Chemical Industries Co., Ltd.) | 0.5 parts |
| hydrocarbon wax (Tm = 78° C.) | 10.0 parts |
| polyester resin | 5.0 parts |

(condensate of bisphenol A-2 mol propylene oxide adduct/terephthalic acid/trimellitic acid, glass transition temperature: 75° C.)

The mixture was then heated to a temperature of 65° C. and a polymerizable monomer composition was subsequently prepared by dissolving and dispersing with stirring at a stirring rate of 10,000 rpm using a T. K. Homomixer (Tokushu Kika Kogyo Co., Ltd.).

The polymerizable monomer composition was then introduced into the aforementioned aqueous medium;

Perbutyl PV (10-hour half-life decomposition temperature=54.6° C. (NOF Corporation)) 7.0 parts was added as polymerization initiator; and granulation was performed by stirring at a temperature of 70° C. for 20 minutes at a stirring rate of 15,000 rpm using a T. K. Homomixer.

The stirrer was changed over to a propeller-type stirrer and, while stirring at a stirring rate of 200 rpm, a polymerization reaction was run on the styrene and n-butyl acrylate, which were the polymerizable monomers in the polymerizable monomer composition, for 5 hours at a temperature of 85° C. to produce a toner particle-containing slurry. The slurry was cooled when the polymerization reaction was finished. Hydrochloric acid was added to the cooled slurry to bring the pH to 1.4 and the calcium phosphate salt was dissolved by stirring for 1 hour. The slurry was then washed with 10-fold water and filtered and dried, and the particle diameter was then adjusted by classification to obtain a toner particle.

1.5 parts of hydrophobic silica fine particles (primary particle diameter: 7 nm, BET specific surface area: 130 $m^2/g$), which had been treated with dimethylsilicone oil at 20 mass % with reference to the silica fine particles, was mixed as external additive with 100.0 parts of the aforementioned toner particle for 15 minutes at a stirring rate of 3,000 rpm using a Mitsui Henschel mixer (Mitsui Miike Chemical Engineering Machinery Co., Ltd.) to obtain a toner 25.

The weight-average particle diameter (D4) of the toner particle was 7.6 μm. The THF-insoluble matter A was 0 mass %, the THF-insoluble matter B was 0 mass %, and the degree of THF swelling of the THF-insoluble matter B was 22.0. The properties are given in Table 3.

Toner 26 Production

An aqueous medium was prepared by adding 9.0 parts of tricalcium phosphate to 1300.0 parts of deionized water heated to a temperature of 60° C. and stirring at a stirring rate of 15,000 rpm using a T. K. Homomixer (Tokushu Kika Kogyo Co., Ltd.).

In addition, a mixture was prepared by mixing the following binder resin starting materials while stirring at a stirring rate of 100 rpm using a propeller-type stirrer.

| | |
|---|---|
| styrene | 32.5 parts |
| n-butyl acrylate | 17.5 parts |
| compound 2 solution | 40.0 parts |

The following were then added to the resulting solution.

| | |
|---|---|
| cyan colorant (C. I. Pigment Blue 15:3) | 6.5 parts |
| negative charge control agent (Bontron E-84, Orient Chemical Industries Co., Ltd.) | 0.5 parts |
| hydrocarbon wax (Tm = 78° C.) | 10.0 parts |
| polyester resin | 5.0 parts |

(condensate of bisphenol A-2 mol propylene oxide adduct/terephthalic acid/trimellitic acid, glass transition temperature: 75° C.)

The mixture was then heated to a temperature of 65° C. and a polymerizable monomer composition was subsequently prepared by dissolving and dispersing with stirring at a stirring rate of 10,000 rpm using a T. K. Homomixer (Tokushu Kika Kogyo Co., Ltd.).

The polymerizable monomer composition was then introduced into the aforementioned aqueous medium;

Perbutyl PV (10-hour half-life decomposition temperature=54.6° C. (NOF Corporation)) 7.0 parts was added as polymerization initiator; and granulation was performed by stirring at a temperature of 70° C. for 20 minutes at a stirring rate of 15,000 rpm using a T. K. Homomixer.

The stirrer was changed over to a propeller-type stirrer and, while stirring at a stirring rate of 200 rpm, a polymerization reaction was run on the styrene and n-butyl acrylate, which were the polymerizable monomers in the polymerizable monomer composition, for 5 hours at a temperature of 85° C. to produce a toner particle-containing slurry. The slurry was cooled when the polymerization reaction was finished. Hydrochloric acid was added to the cooled slurry to bring the pH to 1.4 and the calcium phosphate salt was dissolved by stirring for 1 hour. The slurry was then washed with 10-fold water and filtered and dried, and the particle diameter was then adjusted by classification to obtain a toner particle.

1.5 parts of hydrophobic silica fine particles (primary particle diameter: 7 nm, BET specific surface area: 130 $m^2/g$), which had been treated with dimethylsilicone oil at 20 mass % with reference to the silica fine particles, was mixed as external additive with 100.0 parts of the aforementioned toner particle for 15 minutes at a stirring rate of 3,000 rpm using a Mitsui Henschel mixer (Mitsui Miike Chemical Engineering Machinery Co., Ltd.) to obtain a toner 26.

The weight-average particle diameter (D4) of the toner particle was 7.7 μm. The THF-insoluble matter A was 0 mass %, the THF-insoluble matter B was 2 mass %, and the degree of THF swelling of the THF-insoluble matter B was 1.5. The properties are given in Table 3.

TABLE 3

| | CA | Parts | THF-insoluble matter A mass % | THF-insoluble matter B mass % | Degree of THF swelling |
|---|---|---|---|---|---|
| Toner 1 | CA 1 | 1.4 | 5 | 35 | 5.0 |
| Toner 2 | CA 1 | 1.1 | 3 | 20 | 8.0 |
| Toner 3 | CA 1 | 1.3 | 5 | 30 | 6.0 |
| Toner 4 | CA 1 | 0.9 | 0 | 7 | 10.0 |
| Toner 5 | CA 1 | 2.1 | 8 | 50 | 4.0 |
| Toner 6 | CA 2 | 0.7 | 8 | 35 | 13.0 |
| Toner 7 | CA 3 | 1.8 | 6 | 40 | 5.0 |
| Toner 8 | CA 4 | 0.5 | 5 | 35 | 15.0 |
| Toner 9 | CA 5 | 1.7 | 8 | 45 | 5.0 |
| Toner 10 | CA 6 | 1.1 | 8 | 40 | 16.0 |
| Toner 11 | CA 7 | 1.3 | 8 | 40 | 18.0 |
| Toner 12 | CA 8 | 1.5 | 10 | 25 | 5.0 |
| Toner 13 | CA 9 | 1.5 | 2 | 30 | 12.0 |
| Toner 14 | CA 10 | 1.5 | 2 | 40 | 14.0 |
| Toner 15 | CA 11 | 1.5 | 2 | 40 | 13.0 |
| Toner 16 | CA 12 | 1.5 | 2 | 40 | 13.0 |
| Toner 17 | CA 1 | 1.1 | 3 | 20 | 5.0 |
| Toner 18 | CA 1 | 1.1 | 3 | 20 | 5.0 |
| Toner 19 | CA 13 | 0.6 | 40 | 0 | — |
| Toner 20 | CA 14 | 0.5 | 40 | 0 | — |

TABLE 3-continued

| | CA | Parts | THF-insoluble matter A mass % | THF-insoluble matter B mass % | Degree of THF swelling |
|---|---|---|---|---|---|
| Toner 21 | CA 15 | 0.4 | 50 | 0 | — |
| Toner 22 | CA 16 | 1.2 | 30 | 10 | 4.0 |
| Toner 23 | CA 1 | 2.5 | 10 | 60 | 3.0 |
| Toner 24 | CA 2 | 0.3 | 0 | 3 | 20.0 |
| Toner 25 | Conmpound 1 | 43 | 0 | 0 | — |
| Toner 26 | Conmpound 2 | 20 | 0 | 2 | 1.5 |

In the table

CA indicates "crosslinking agent", and the number of parts represents the number of parts per 100 parts of the polymerizable monomer.

Binder Resin A Production

The following materials were metered into a reactor fitted with a condenser, stirrer, and nitrogen introduction line.

styrene: 75.0 parts
n-butyl acrylate: 25.0 parts
crosslinking agent 1: 1.1 parts
Perbutyl PV (NOF Corporation): 7.0 parts
toluene: 100.0 parts After then stirring to uniformity, bubbling with nitrogen was performed for 10 minutes followed by heating to 75° C. under a nitrogen flow. A reaction was carried out for 6 hours; reprecipitation purification was performed using THF for the good solvent and methanol for the precipitant; and vacuum drying then yielded a binder resin A.

Toner 17 Production

Production of Core Resin Fine Particle Dispersion 1 binder resin A: 60.0 parts
anionic surfactant (Neogen RK, Dai-ichi Kogyo Seiyaku Co., Ltd.): 0.2 parts N,N-dimethylaminoethanol: 1.9 parts
tetrahydrofuran: 200.0 parts The preceding were mixed, dissolved, and stirred at 4,000 rpm using a T. K. Robomix (PRIMIX Corporation) ultra-high-speed stirrer. 177.8 parts of deionized water was added dropwise and the tetrahydrofuran was then removed using an evaporator to obtain a core resin fine particle dispersion 1. The particle diameter on a volume basis of the resin fine particles in the dispersion was measured at 0.22 μm using a dynamic light-scattering particle size distribution analyzer (Nanotrac, Nikkiso Co., Ltd.).

Production of Shell Resin Fine Particle Dispersion 1 polyester resin B: 60 parts
anionic surfactant (Neogen RK, Dai-ichi Kogyo Seiyaku Co., Ltd.): 0.3 parts
N,N-dimethylaminoethanol: 1.9 parts
tetrahydrofuran: 200.0 parts Polyester resin B is the polycondensate of terephthalic acid:isophthalic acid:propylene oxide-modified bisphenol A (2 mol adduct):ethylene oxide-modified bisphenol A (2 mol adduct)=20:20:44:50 (mass ratio), with Mn=3,200 and Mw=7,000.

Using the preceding, production was carried out by the same procedure as for the aforementioned core resin fine particle dispersion to obtain a shell resin fine particle dispersion 1. The particle diameter on a volume basis of the resin fine particles in the dispersion was 0.09 μm.

Aqueous Dispersion of Colorant Fine Particles copper phthalocyanine pigment (Pigment Blue 15:3): 100 parts anionic surfactant (Neogen RK, Dai-ichi Kogyo Seiyaku Co., Ltd.): 15 parts deionized water: 885 parts The preceding were mixed and dispersion was carried out for 1 hour using a Nanomizer high-pressure impact-type disperser (Yoshida Kikai Co., Ltd.) to prepare an aqueous dispersion of colorant fine particles in which the colorant was dispersed. The particle diameter on a volume basis of the colorant fine particles in the aqueous colorant fine particle dispersion was measured at 0.20 μm using a dynamic light-scattering particle size distribution analyzer.

Aqueous Dispersion of Release Agent Fine Particles hydrocarbon wax (melting point 78° C., Nippon Seiro Co., Ltd.): 100 parts anionic surfactant (Neogen RK, Dai-ichi Kogyo Seiyaku Co., Ltd.): 10 parts deionized water: 880 parts The preceding were introduced into a stirrer-equipped mixing vessel and were then heated to 90° C. and, while being circulated to a Clearmix W Motion (M Technique Co., Ltd.), were subjected to a dispersion treatment for 60 minutes by stirring under conditions of a rotor rotation rate of 19,000 rpm and a screen rotation rate of 19,000 rpm using a rotor outer diameter of 3 cm and a clearance of 0.3 mm at the shear agitation section. This was followed by cooling to 40° C. using cooling process conditions of a rotor rotation rate of 1,000 rpm, a screen rotation rate of 0 rpm, and a cooling rate of 10° C./min to obtain an aqueous dispersion of release agent fine particles. The particle diameter on a volume basis of the release agent fine particles in the aqueous release agent fine particle dispersion was measured at 0.15 μm using a dynamic light-scattering particle size distribution analyzer.

Preparation of Core Particle Dispersion core resin fine particle dispersion 1: 40 parts
aqueous colorant fine particle dispersion: 10 parts
aqueous release agent fine particle dispersion: 20 parts
1 mass % aqueous magnesium sulfate solution: 20 parts
deionized water: 140 parts The preceding were dispersed using a homogenizer (Ultra-Turrax T50, IKA), followed by heating to 45° C. on a water heating bath while stirring with a stirring blade. After holding for 1 hour at 45° C., observation with an optical microscope confirmed the formation of aggregated particles having an average particle diameter of 5.5 μm. 40 parts of a 5 mass % aqueous trisodium citrate solution was added, followed, while continuing to stir, by heating to 85° C. and holding for 120 minutes to effect core particle coalescence.

Then, while continuing to stir, water was introduced into the water bath to bring about cooling to 25° C. and obtain a core particle dispersion. Measurement of the particle diameter of the core particles in the core particle dispersion using a particle size distribution analyzer based on the Coulter principle (Coulter Multisizer III, Coulter Corporation) gave a weight-average particle diameter (D4) for the core particles in the core particle dispersion of 4.5 μm.

Toner Particle Production 1,000 parts of the core particle dispersion was introduced into a tall beaker and stirring was performed with a stirring blade at 25° C. on a water heating bath. 113 parts of the shell resin fine particle dispersion 1 was then added with stirring for 10 minutes. 200 parts of a 2 mass % aqueous calcium chloride solution was slowly added dropwise.

While in this state, a small amount of the liquid was periodically extracted and was passed through a 2-μm microfilter, and stirring at 25° C. was continued until the filtrate became transparent. Once it had been confirmed that the filtrate was transparent, the temperature was raised to 40° C., 133 parts of a 5 mass % aqueous trisodium citrate solution was added, the temperature was raised to 65° C., and stirring was carried out for 1.5 hours. This was followed by cooling the obtained liquid to 25° C., carrying out filtration and solid-liquid separation, adding 800 parts of deionized water to the solids, and washing by stirring for 30 minutes.

Filtration and solid-liquid separation were carried out again. In order to extinguish the influence of residual surfactant, filtration and washing as described above were repeated until the electrical conductivity of the filtrate reached 150 μS/cm or less. Drying the obtained solids gave a core/shell-structured toner particle 18. The weight-average particle diameter (D4) of the obtained core/shell-structured toner particle 18 was 6.6 μm, and it was thus concluded that the toner particle had been obtained without agglomeration.

The THF-insoluble matter A was 3 mass %, the THF-insoluble matter B was 20 mass %, and the degree of THF swelling of the THF-insoluble matter B was 5.0.

External addition was carried out on the resulting toner particle using the same method as for toner 1 to obtain a toner 17. The properties of the obtained toner 17 are given in Table 3.

Toner 18 Production binder resin A: 100.0 parts
methyl ethyl ketone: 100.0 parts
ethyl acetate: 100.0 parts
hydrocarbon wax (melting point 78° C., Nippon Seiro Co., Ltd.): 12.0 parts
copper phthalocyanine pigment (Pigment Blue 15:3): 6.5 parts
negative charge control agent (Bontron E-88, Orient Chemical Industries Co., Ltd.): 1.0 parts These materials were dispersed for 3 hours using an attritor (Mitsui Mining & Smelting Co., Ltd.) to obtain a colorant dispersion.

On the other hand, 27 parts of tricalcium phosphate was added to 3,000 parts of deionized water that had been heated to a temperature of 60° C., and an aqueous medium was prepared by stirring at a stirring rate of 10,000 rpm using a T. K. Homomixer (Tokushu Kika Kogyo Co., Ltd.). The aforementioned colorant dispersion was introduced into this aqueous medium and stirring was carried out at a temperature of 65° C. in a $N_2$ atmosphere for 15 minutes at a stirring rate of 12,000 rpm using a T. K. Homomixer to carry out granulation into colorant particles. The T. K. Homomixer was then changed to a common propeller stirrer and, while holding the stirring rate with this stirrer at 150 rpm, the internal temperature was raised to 95° C. and holding was carried out for 3 hours to remove the solvent from the dispersion and produce a toner particle dispersion.

Hydrochloric acid was added to the obtained toner particle dispersion to bring the pH to 1.4 and the calcium phosphate salt was dissolved by stirring for 1 hour. This dispersion was filtered and washed using a pressure filter to obtain a toner aggregate. The toner aggregate was subsequently broken up and dried to obtain a toner particle.

The weight-average particle diameter (D4) of the toner particle was 6.0 μm. The THF-insoluble matter A was 3 mass %, the THF-insoluble matter B was 20 mass %, and the degree of THF swelling of the THF-insoluble matter B was 5.0.

External addition was carried out on the resulting toner particle using the same method as for toner 1 to obtain a toner 18. The properties of the obtained toner 18 are given in Table 3.

Image Evaluations

The evaluations were performed using a partially modified commercial color laser printer [HP LaserJet Enterprise Color M553dn]. The modification enabled operation with the process cartridge for just one color installed. Another modification enabled the temperature at the fixing unit to be freely varied.

The toner in the black toner process cartridge installed in this color laser printer was removed; the interior was cleaned with an air blower; the particular toner (350 g) was introduced into the process cartridge; the toner-refilled process cartridge was installed in the color laser printer; and the following image evaluations were performed. The specific items in the image evaluation are as follows.

Offset Property

The evaluation was performed by changing the fixation temperature (10° C. intervals in the range from 190° C. to 210° C.) of a halftone (toner laid-on level: 0.3 mg/cm') image on the transfer material. The fixation temperature is the value measured for the fixing roller surface using a noncontact thermometer. Plain paper (XEROX 4200 paper, letter size, 75 g/$m^2$, Xerox Corporation) was used for the transfer material. Evaluation was carried out using the following criteria, wherein a score of C or better was regarded as excellent.

Evaluation Criteria

A: offset does not occur at 210° C.
B: offset is produced at 210° C.
C: offset is produced at 200° C.
D: offset is produced at 190° C.

Gloss

A solid image (toner laid-on level: 0.6 mg/$cm^2$) was printed at a fixation temperature of 170° C., and the gloss value was measured using a PG-3D (Nippon Denshoku Industries Co., Ltd.). Letter-size plain paper (XEROX 4200 paper, Xerox Corporation, 75 g/$m^2$) was used as the transfer material. Evaluation was carried out using the following criteria, wherein a score of C or better was regarded as excellent.

Evaluation Criteria

A: the gloss value is equal to or greater than 30
B: the gloss value is less than 30 and equal to or greater than 20
C: the gloss value is less than 20 and equal to or greater than 15
D: the gloss value is less than 15

Evaluation of Tinting Strength (Image Density)

The toner-filled process cartridge was held for 48 hours in a normal-temperature, normal-humidity environment (temperature 23° C./relative humidity 50%: N/N environment in the following). An unfixed image was output using an LBP-7700C (Canon, Inc.) that had been modified to operate with the fixing unit detached; this unfixed image was an image pattern of a 10 mm×10 mm square image uniformly arrayed at 9 points on the transfer paper (GF-0081 (Canon, Inc.), A4: 81.4 g/$m^2$). The toner laid-on level on the transfer paper was 0.45 mg/cm'.

The fixing unit of the LBP-7700C was removed to the exterior and was configured to operate even outside the laser printer, and this external fixing unit was used as the fixing unit. Fixing was carried out using conditions of a fixation temperature of 160° C. and a process speed of 240 mm/sec.

Using a "MacBeth RD918 Reflection Densitometer" (MacBeth Corporation) in accordance with the instruction manual provided with the instrument, the image density of the 10 mm×10 mm square images was measured by measuring the relative density versus the image in a white background region having an image density of 0.00. The relative densities obtained at the 9 points were averaged and this was used for the value of the image density. The tinting strength was evaluated using the image density as the index and using the following criteria. A score of C or better was regarded as excellent.

Evaluation Criteria

A: The image density is at least 1.40.

B: The image density is at least 1.30, but less than 1.40.

C: The image density is at least 1.20, but less than 1.30.

D: The image density is less than 1.20.

Streaking (Developing Performance)

Operating in a high-temperature, high-humidity environment (temperature 32° C./humidity 80% RH), a 50,000-print print-out test was performed using a horizontal line image having a print percentage of 1%. After the completion of this test, a halftone (toner laid-on level: 0.3 mg/cm$^2$) image was printed out on letter-size XEROX 4200 paper (75 g/m$^2$, Xerox Corporation), and the presence/absence of vertical streaks in the halftone image in the paper discharge direction was scored and evaluated using the following criteria. A score of C or better was regarded as excellent.

Evaluation Criteria

A: no production

B: vertical streaks in the paper discharge direction are produced at 1 to 3 locations in the halftone image C: vertical streaks in the paper discharge direction are produced at 4 to 6 locations in the halftone image D: vertical streaks in the paper discharge direction are produced at 7 or more locations in the halftone image, or a vertical streak with a width of 0.5 mm or more is produced

Examples 1 to 18

The evaluations given above were performed in Examples 1 to 18 using each of toners 1 to 18 for the toner. The results of the evaluations are given in Table 4.

Comparative Examples 1 to 8

The evaluations given above were performed in Comparative Examples 1 to 8 using each of toners 19 to 26 for the toner. The results of the evaluations are given in Table 4.

TABLE 4

| | | Offset property | Gloss | Tinting strength (image density) | Streaking (developing performance) |
|---|---|---|---|---|---|
| Example 1 | Toner 1 | A | A(40) | A(1.50) | A(0) |
| Example 2 | Toner 2 | A | A(40) | A(1.50) | A(0) |
| Example 3 | Toner 3 | A | A(40) | A(1.50) | A(0) |
| Example 4 | Toner 4 | B | A(40) | A(1.50) | B(1) |
| Example 5 | Toner 5 | A | B(20) | A(1.45) | A(0) |
| Example 6 | Toner 6 | A | A(30) | B(1.38) | A(0) |
| Example 7 | Toner 7 | A | A(35) | A(1.45) | A(0) |
| Example 8 | Toner 8 | A | B(25) | B(1.36) | A(0) |
| Example 9 | Toner 9 | A | B(20) | A(1.40) | A(0) |
| Example 10 | Toner 10 | A | B(25) | B(1.34) | A(0) |
| Example 11 | Toner 11 | A | C(15) | B(1.30) | A(0) |
| Example 12 | Toner 12 | A | B(20) | A(1.40) | A(0) |
| Example 13 | Toner 13 | B | A(35) | B(1.30) | C(4) |
| Example 14 | Toner 14 | B | A(30) | B(1.34) | C(4) |
| Example 15 | Toner 15 | B | B(25) | B(1.34) | C(6) |
| Example 16 | Toner 16 | B | A(30) | B(1.36) | C(4) |
| Example 17 | Toner 17 | A | A(30) | A(1.40) | A(0) |
| Example 18 | Toner 18 | A | A(30) | A(1.40) | A(0) |
| Comparative Example 1 | Toner 19 | A | D(5) | C(1.26) | A(0) |
| Comparative Example 2 | Toner 20 | A | D(10) | C(1.22) | A(0) |
| Comparative Example 3 | Toner 21 | A | D(10) | C(1.20) | A(0) |
| Comparative Example 4 | Toner 22 | A | D(10) | C(1.28) | A(0) |
| Comparative Example 5 | Toner 23 | A | D(10) | B(1.30) | A(0) |
| Comparative Example 6 | Toner 24 | D | A(30) | A(1.50) | D(7) |
| Comparative Example 7 | Toner 25 | D | B(25) | D(1.00) | D(9) |
| Comparative Example 8 | Toner 26 | D | B(20) | D(1.10) | D(10) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-204456, filed Oct. 30, 2018, Japanese Patent Application No. 2019-060041, filed Mar. 27, 2019, which are hereby incorporated by reference herein in their entirety.

What is claimed is:

1. A toner comprising;

a toner particle comprising a binder resin, said binder resin containing a copolymer of a crosslinking agent, a styrenic polymerizable monomer, and at least one member selected from the group consisting of acrylic polymerizable monomers and methacrylic polymerizable monomers;

the crosslinking agent being provided by a Michael addition reaction of a polyvalent mercapto compound represented by formula (2) to a multifunctional (meth) acrylate compound represented by formula (1)

(1)

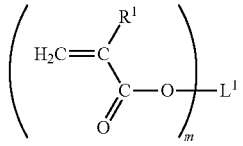

where $R^1$ represents a hydrogen atom or an alkyl group having 1 to 4 carbon atoms, $L^1$ represents an m-valent linear or branched aliphatic hydrocarbon group optionally having a hydroxy group, or an ether bond-containing m-valent linear or branched aliphatic hydrocarbon group optionally having a hydroxy group, and m is an integer of 3 to 6, and (2)

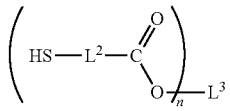

where $L^2$ represents an alkylene group, $L^3$ represents an n-valent linear or branched aliphatic hydrocarbon group optionally having a hydroxy group, or an ether bond-containing n-valent linear or branched aliphatic hydrocarbon group optionally having a hydroxy group, and n is an integer from 3 to 6, wherein an amount of a tetrahydrofuran-insoluble matter A collected when a tetrahydrofuran dispersion of the binder resin is passed through a first filter having an average pore diameter of 8 μm is not more than 10 mass % of the binder resin, and an amount of a tetrahydrofuran-insoluble matter B collected when the tetrahydrofuran dispersion that has been passed through the first filter is passed through a second filter having an average pore diameter of 0.8 μm is 5 to 50 mass % of the binder resin.

2. The toner according to claim 1, wherein a degree of tetrahydrofuran swelling of the tetrahydrofuran-insoluble matter B is 2.0 to 20.0.

* * * * *